US008672313B2

(12) United States Patent
Fukami

(10) Patent No.: US 8,672,313 B2
(45) Date of Patent: Mar. 18, 2014

(54) SHEET PROCESSING DEVICE, IMAGE FORMING APPARATUS, AND SHEET PROCESSING METHOD

(75) Inventor: Kentaroh Fukami, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 188 days.

(21) Appl. No.: 13/398,896

(22) Filed: Feb. 17, 2012

(65) Prior Publication Data

US 2012/0217693 A1 Aug. 30, 2012

(30) Foreign Application Priority Data

Feb. 28, 2011 (JP) ..... 2011-042608

(51) Int. Cl.
*B65H 37/04* (2006.01)

(52) U.S. Cl.
USPC ..... 270/58.09; 270/58.11; 270/58.16; 270/58.17; 399/410

(58) Field of Classification Search
USPC ..... 270/58.08, 58.09, 58.11, 58.12, 58.16, 270/58.17; 399/410
See application file for complete search history.

(56) References Cited

U.S. PATENT DOCUMENTS

| | | | | |
|---|---|---|---|---|
| 5,384,634 | A * | 1/1995 | Takehara et al. | 399/410 |
| 5,839,048 | A * | 11/1998 | Kato | 399/407 |
| 5,938,186 | A * | 8/1999 | Sato et al. | 270/58.11 |
| 6,527,269 | B2 * | 3/2003 | Yamada et al. | 271/221 |
| 6,561,503 | B1 * | 5/2003 | Ogata et al. | 270/58.12 |
| 6,886,828 | B2 * | 5/2005 | Saito | 271/225 |
| 7,192,020 | B2 * | 3/2007 | Hayashi et al. | 270/58.11 |
| 7,392,983 | B2 * | 7/2008 | Kodama et al. | 271/249 |
| 7,578,497 | B2 * | 8/2009 | Kawata et al. | 270/37 |
| 7,954,801 | B2 * | 6/2011 | Fukami | 270/58.11 |
| 8,132,803 | B2 * | 3/2012 | Ogata et al. | 270/58.12 |
| 2010/0019435 | A1 * | 1/2010 | Fukami | 270/58.11 |
| 2010/0237556 | A1 | 9/2010 | Azuma et al. | |
| 2011/0074081 | A1 | 3/2011 | Hirabayashi et al. | |
| 2011/0091260 | A1 | 4/2011 | Azuma et al. | |

FOREIGN PATENT DOCUMENTS

| | | | |
|---|---|---|---|
| JP | 3466942 | B2 | 6/2000 |
| JP | 2000289921 | A | 10/2000 |
| JP | 2000335815 | A | 12/2000 |
| JP | 2002154734 | A | 5/2002 |
| JP | 2002241030 | A | 8/2002 |
| JP | 2006232452 | A | 9/2006 |
| JP | 4616722 | B2 | 2/2007 |

OTHER PUBLICATIONS

Abstract of JP 2007-031134 published Feb. 8, 2007.
Abstract of JP 2000-177920 published Jun. 27, 2000.
Abstract of JP 2002-154734 published May 28, 2002.

(Continued)

*Primary Examiner* — Patrick Mackey
(74) *Attorney, Agent, or Firm* — Harness, Dickey & Pierce, P.L.C.

(57) ABSTRACT

A sheet processing device for stacking one or more sheets temporarily on a stacking unit, and stapling the sheets by a stapling unit after aligned by an alignment unit. The device includes a shift unit that shifts the sheet in both a sheet conveying direction and a direction orthogonal to the sheet conveying direction, and a control unit that controls a shift amount of the shift unit so that an alignment distance of a width direction alignment unit to align the sheet in the direction orthogonal to the sheet conveying direction is constant regardless of a staple position and a sheet size, when stacking the sheets on the stacking unit.

8 Claims, 15 Drawing Sheets

(56) References Cited

OTHER PUBLICATIONS

Abstract of JP 2000-335815 published Dec. 5, 2000.
Abstract of JP 2002-241030 published Aug. 28, 2002.
Abstract of JP 2000-289921 published Oct. 17, 2000.
Abstract of JP 2006-232452 published Sep. 7, 2006.

* cited by examiner

SHEET PROCESSING DEVICE, IMAGE FORMING APPARATUS, AND SHEET PROCESSING METHOD

CROSS-REFERENCE TO RELATED APPLICATIONS

The present application claims priority to and incorporates by reference the entire contents of Japanese Patent Application No. 2011-042608 filed in Japan on Feb. 28, 2011.

BACKGROUND OF THE INVENTION

1. Field of the Invention

The present invention relates to a sheet processing device that performs predetermined processes on a conveyed sheet-like recording medium (referred to as "sheet" in this specification), an image forming apparatus provided with the sheet processing device, such as a copier, a printer, a facsimile, or a digital MFP (multifunction peripheral), and a sheet processing method that is performed by the sheet processing device or the image forming apparatus.

2. Description of the Related Art

The following methods are known as conventional sheet alignment operations during, for example, a stapling process. For example, in the method disclosed in Paragraphs 0026 to 0031 of Japanese Patent Application Laid-open No. 2007-031134, a hit roller brings back an ejected sheet to a rear end reference fence to align the sheet in the lengthwise direction and jogger fences align the sheet in the widthwise direction around a center axis in the sheet conveying direction. In the method disclosed in Paragraphs 0097 to 0101 of Japanese Patent Application Laid-open No. 2000-177920, multiple alignment positions are set to align a sheet in the sheet width direction.

In a conventional method, when a sheet is aligned with reference to the center axis in the sheet conveying direction regardless of sheet size, a mechanism to move the stapler obliquely is necessary in order to perform parallel stapling and oblique stapling.

If there are multiple alignment positions, changing the alignment position in accordance with the stapling position makes it unnecessary to have a mechanism to obliquely move the stapler. However, as the sheet width reduces, the distance that the jogger fences move increases, which leads to concerns about productivity reduction and sheet alignment degradation.

SUMMARY OF THE INVENTION

It is an object of the present invention to at least partially solve the problems in the conventional technology.

A sheet processing device for stacking one or more sheets temporarily on a stacking unit, and stapling the sheets by a stapling unit after aligned by an alignment unit. The device is provided with a shift unit that shifts the sheet in both a sheet conveying direction and a direction orthogonal to the sheet conveying direction, and a control unit that controls a shift amount of the shift unit so that an alignment distance of a width direction alignment unit to align the sheet in the direction orthogonal to the sheet conveying direction is constant regardless of a staple position and a sheet size, when stacking the sheets on the stacking unit.

An image forming apparatus provided with a sheet processing device for stacking one or more sheets temporarily on a stacking unit, and stapling the sheets by a stapling unit after aligned by an alignment unit. The device includes a shift unit that shifts the sheet in both a sheet conveying direction and a direction orthogonal to the sheet conveying direction, and a control unit that controls a shift amount of the shift unit so that an alignment distance of a width direction alignment unit to align the sheet in the direction orthogonal to the sheet conveying direction is constant regardless of a staple position and a sheet size, when stacking the sheets on the stacking unit.

A sheet processing method for conveying one or more sheets with a conveying unit, stacking the sheets temporarily on a stacking unit, and stapling the sheets by a stapling unit after aligned by an alignment unit. The method includes conveying the sheets with the conveying unit in a direction orthogonal to a sheet conveying direction so that an alignment distance of a width direction alignment unit to align the sheets in the direction orthogonal to the sheet conveying direction is constant regardless of a staple positron and a sheet size, before ejecting the sheets onto the stacking unit to stack the sheets thereon.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
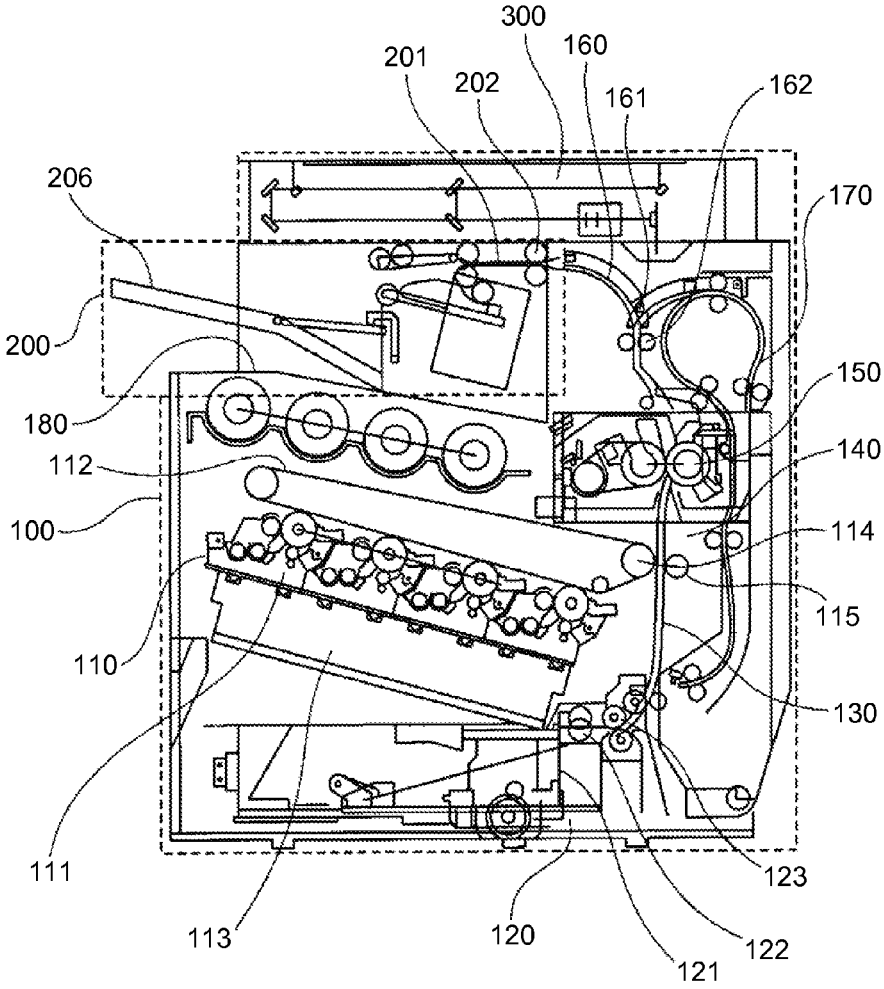
FIG. 1 is a diagram depicting a schematic system configuration of an image forming system according to an embodiment of the present invention.

According to an embodiment of the present invention, a sheet when ejected to the staple tray is conveyed and aligned in the sheet conveying direction and also in the direction orthogonal to the sheet conveying direction by a conveying unit (conveying rollers) configured to convey the sheet to the staple tray. The moving distance of the alignment unit for aligning a sheet in the direction orthogonal to the sheet conveying direction can be constant regardless of the sheet size and the stapling position.

Embodiments of the present invention will be described below with reference to the drawings. In the following descriptions, equivalent components are denoted by the same reference numerals and redundant descriptions will be omitted as appropriate.

Incidentally, in the embodiments described below, a sheet or sheets correspond to a reference number 216, a stacking unit corresponds to a staple tray 209, a sheet group or bundle of sheets corresponds to a reference number 218, a staple unit corresponds to a stapler 215, a shift unit corresponds to staple sheet eject rollers 203 and a drive mechanism (not shown) for the staple sheet eject rollers 203, a width direction alignment unit corresponds to jogger fences 213 and 214, a controller corresponds to a CPU 401, conveying rollers corresponds to a pair of inlet rollers 202, a conveying direction alignment unit corresponds to a rear end reference fence 212 and a hit roller 210, a moving unit corresponds to a moving drive mechanism (not shown), a sheet processing device corresponds to a reference number 200, and an image forming apparatus corresponds to a reference number 100, respectively.

1. Overall Configuration

FIG. 1 is a diagram depicting a schematic system configuration of an image forming system according to an embodiment of the present invention. As shown in FIG. 1, the image forming system according to the embodiment includes an image forming apparatus 100, a sheet processing device 200, and an image reading device 300.

The image forming apparatus 100 is an indirect transfer tandem color image forming apparatus including an image forming unit 110 with four-color image forming stations 111 arranged at approximately the center in FIG. 1; an optical writing unit 113 provided adjacent to the bottom of the image forming unit 110; a sheet feeder 120 provided below the image forming unit 110; a sheet feeding conveying path (vertical conveying path) 130 along which a sheet picked up by the sheet feeder 120 is conveyed to a secondary transfer unit 140 and a fixing unit 150; a sheet eject path 160 along which a sheet on which an image is fixed is conveyed toward the sheet processing device 200; and a duplex conveying path 170 to invert a sheet, with one side on which an image is formed, to form an image on the other side.

The image forming unit 110 includes YMCK photosensitive drums of the image forming stations 111. Along each outer circumference of drums, a charging unit, a developing unit, a primary transfer unit, a cleaning unit, and a neutralization unit are arranged. The image forming unit 110 further includes an intermediate transfer belt 112 on which images formed on the photosensitive drums are transferred by each primary transfer unit by performing an intermediate transfer. The image forming unit 110 further includes an optical writing unit 113 to write images of the respective colors on the photosensitive drums. The optical writing unit 113 is arranged below the image forming stations 111. The intermediate transfer belt 112 is arranged above the image forming stations 111. The intermediate transfer belt 112 is rotatably supported by a plurality of support rollers. One of support rollers 114 faces a secondary transfer roller 115 via the intermediate transfer belt 112 at the secondary transfer unit 140, such that an image on the intermediate transfer belt 112 can be transferred onto a sheet through a secondary transfer. Since the image forming process performed by the indirect transfer tandem color image forming apparatus is well known and does not directly relates to the gist of the present invention, detailed descriptions thereof will be omitted.

The sheet feeder 120 includes a sheet feeding tray 121, a pickup roller 122, and sheet conveying rollers 123. The sheet feeder 120 sends upward a sheet picked up from the sheet feeding tray 121 along the vertical conveying path 130. An image is transferred onto the sheet at the secondary transfer unit 140. Then, the sheet is sent to the fixing unit 150. The fixing unit 150 includes a fixing roller and a pressing roller. During a process in which the sheet passes through the nip between the fixing roller and the pressing roller, heating and pressing are performed, so that the toner is fixed to the sheet.

The sheet eject path 160 and the duplex conveying path 170 are provided downstream with respect to the fixing unit 150. The sheet eject path 160 and the duplex conveying path 170 bifurcate into two directions at a bifurcating claw 161. One of the conveying paths is selected depending on whether the sheet is conveyed to the sheet processing device 200 or the sheet is conveyed to the duplex conveying path 170. Bifurcating conveying rollers 162 are provided very close to the upstream of the bifurcating claw 161 in the sheet conveying direction, applying a conveying force to the sheet.

The sheet processing device 200 is arranged in the image forming apparatus 100 or placed on the top of a housing sheet eject tray 180 of the image forming apparatus 100. The sheet processing device 200 performs predetermined processes on image-formed sheets conveyed from the image forming apparatus 100 and stacks the sheets on an sheet eject tray 206 positioned the most downstream. Detailed descriptions thereof will be given below. As shown in FIG. 1, when the system includes the image reading device 300, the sheet processing device 200 is placed in a recess that is originally a space above the housing sheet eject tray 180 formed on the upper surface of the housing of the image forming apparatus 100 between the image forming apparatus 100 and the image reading device 300. This leads to efficient use of space and increases space saving.

The image reading device 300 is a well-known device that reads an image of an original by performing optical scanning on an original set on an exposure glass. Since the configuration and functions of the image reading device 300 are well known and are not directly relate to the gist of the present invention, detailed descriptions thereof will be omitted.

In the image forming apparatus 100 configured as described above, image data to be used for writing is generated on the basis of original data read from the original by the image reading device 300 or print data transferred from an external device such as PC. The optical writing is performed by the optical writing unit 113 on each photosensitive drum on the basis of the generated image data. The images formed for the respective colors in the image forming stations 111 are sequentially transferred to the intermediate transfer belt 112, so that a color image is formed on the intermediate transfer belt 112 by superposing four-color images. On the other hand, a sheet is fed from the sheet feeding tray 121 in accordance with the image forming process. The sheet is temporarily stopped at a registration roller position (not shown) just before the intermediate transfer unit 140 and sent out in synchronization with the image front edge on the intermediate transfer belt 112. The intermediate transfer unit 140 then performs a secondary transfer on the sheet and the sheet is sent to the fixing unit 150.

The sheet on which the image is fixed at the fixing unit 150 is, in single-sided printing or after duplex printing is performed in duplex printing, conveyed to the sheet eject path 160 by a switching operation of the bifurcating claw 161 or is conveyed to the duplex conveying path 170 for duplex printing. The sheet transferred to the duplex conveying path 170 is, after being inverted, sent to the intermediate transfer unit 140 and, after an image is formed on the other side, the sheet is sent back to the sheet eject path 160. The sheet conveyed to the sheet eject path 160 is then conveyed to the sheet processing device 200. The sheet processing device 200 then performs the predetermined processes or no process on the sheet and the sheet is ejected to the sheet eject tray 206.

2. Sheet Processing Device

Figure 2:
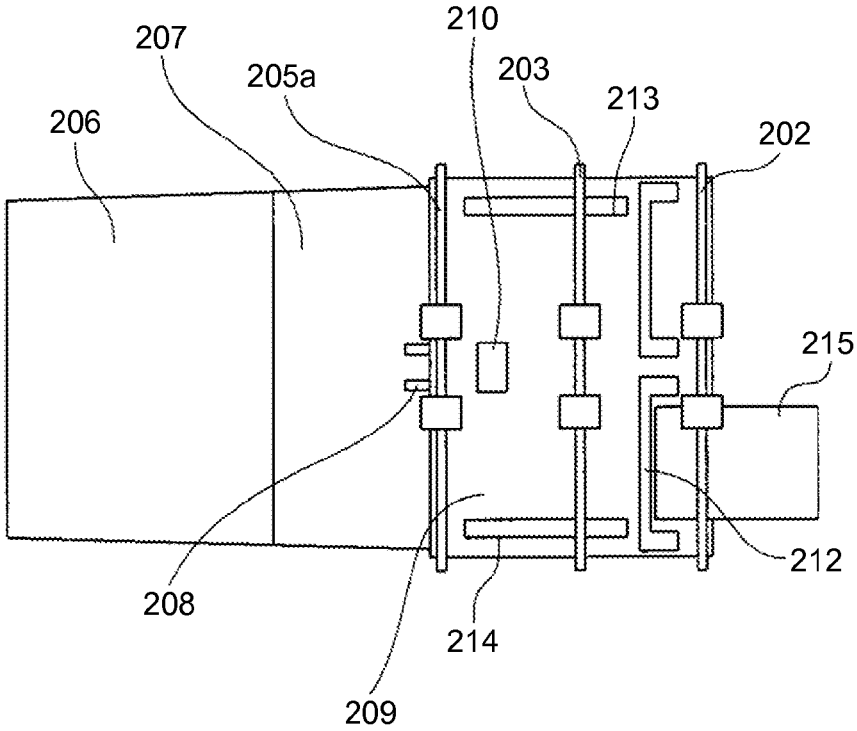
FIG. 2 is a plane view of the sheet processing device shown in FIG. 1.
Figure 3:
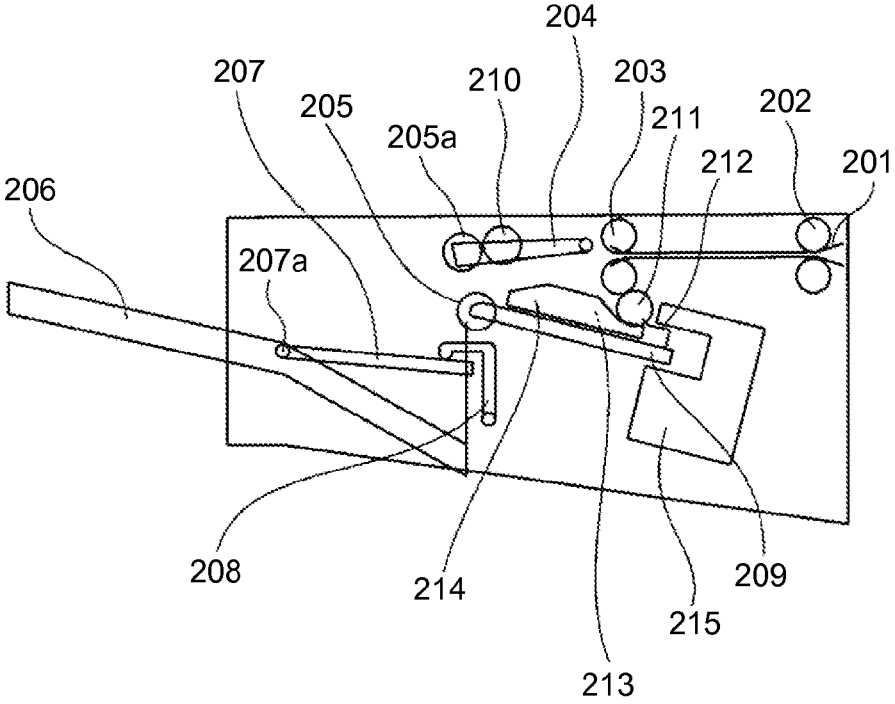
FIG. 3 is a front view depicting a schematic configuration of the sheet processing device shown in FIG. 1.

FIG. 2 is a plan view of the sheet processing device 200 and FIG. 3 is a side view depicting a schematic configuration of the sheet processing device 200, both depicting a basic configuration applied to the embodiment.

As shown in FIG. 2, the sheet processing device 200 includes a pair of inlet rollers 202, a rear end reference fence 212, jogger fences 213 and 214, a stapler 215, a pair of staple sheet eject rollers 203, a hit roller 210, a sheet eject roller 205, a sheet trailing edge pressing unit 208, a movable portion of sheet eject tray 207, and an sheet eject tray 206.

As described in FIG. 3, the sheet processing device 200 further includes a guide plate 201, a staple tray 209, a trailing edge back roller 211, and an openable/closable sheet eject guide plate 204.

In other words, the guide plate 201 for receiving a sheet from the sheet eject path of the image forming apparatus 100 is arranged in the sheet receiving unit of the sheet processing device 200. The pair of inlet rollers 202 are arranged at the most upstream of the guide plate 201 in the sheet conveying direction. The pair of staple sheet eject rollers 203 having a function of shifting and discharging a sheet to the sheet eject tray 206 is provided at the most downstream side of the guide plate 201 in the sheet conveying direction. The sheet is conveyed along the guide plate 201 through the rotation of the inlet rollers 202 and the rotation of the staple sheet eject rollers 203 by using an inlet motor (not shown). The staple sheet eject rollers 203 serve as the conveying unit. However, if the pair of the inlet rollers 202 provided along the guide plate 201 are not separated from each other, both the staple sheet eject rollers 203 and the inlet rollers 202 convey the sheet.

The sheet eject operation is different for a shift mode, in which a sheet is shifted and then ejected (referred to also as "straight sheet eject mode" as the sheet is ejected directly), and a stapling mode, in which multiple sheets are stapled and then ejected. Thus, each mode will be described in conjunction with the configuration of each unit.

2.1 Shift Mode

In the shift mode, the sheet eject position is shifted in the vertical direction with respect to the sheet conveying direction for each predetermined number of sheets, when discharging the sheets. The sheets are sorted by thus shifting the sheet eject position.

Figure 4:
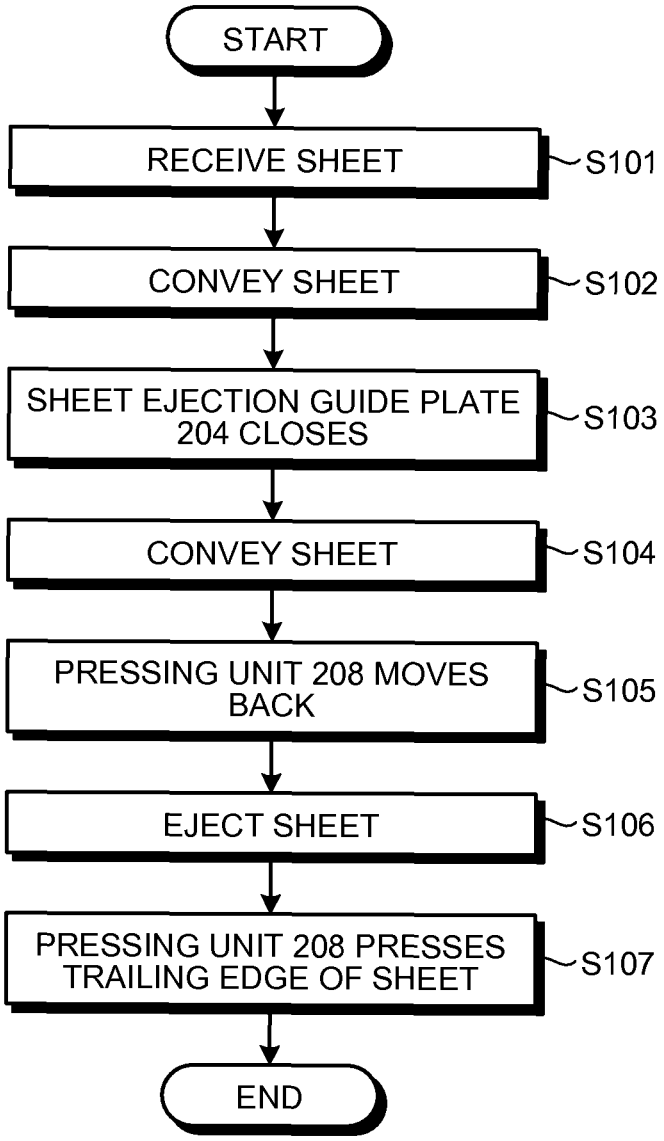
FIG. 4 is a flowchart of a procedure of sheet ejection in a shift mode (straight ejection)

The staple sheet eject rollers 203 are provided at the most downstream end of the guide plate 201 and driven by a shift motor so as to reciprocate in the vertical direction with respect to the sheet conveying direction. That is, they serve as shifting rollers. In other words, when sheets are sorted in the shift mode, the staple sheet eject rollers 203 move in the vertical direction with respect to the sheet conveying direction for each predetermined number of sheets. Thereby, the sheet conveying direction is shifted in the vertical direction corresponding to the moving distance of the rollers 203. Then, the sheets are ejected to the sheet eject tray 206. The shift operation of the sheet conveying direction corresponding to the moving distance of the rollers 203 is a so-called "shift operation". Due to this shift operation, when stacked on the sheet eject tray 206, each group of predetermined number of sheets is displaced from each other, and thus the sheets are sorted. Since the shifting mechanism that allows a shift is a well-known mechanism, for example, as depicted in FIG. 4 of Japanese Patent Application Laid-open No. 2002-241030 and FIG. 3 of Japanese Patent Application Laid-open No. 2002-154734, the description of the shifting mechanism will be omitted.

The openable/closable sheet eject guide plate 204 and the sheet eject roller 205 are arranged downstream of the staple sheet eject rollers 203. The sheet eject roller 205 is driven by a sheet ejection motor (not shown) and a openable/closable sheet eject guide plate 204 can be lifted up/down by a stepping motor (not shown). Sheets are held between and conveyed by the sheet eject roller 205 and a following sheet eject roller 205*a* attached to the openable/closable sheet eject guide plate 204, ejected to the sheet eject tray 206, and stacked on the sheet eject tray 206.

The sheet trailing edge pressing unit 208 to press the sheets stacked on the sheet, eject tray 206 is arranged on the part of the sheet eject tray 206 to be attached to the body of the sheet processing device 200. A sheet-press releasing operation and a sheet pressing operation are performed by turning on/off a solenoid (not shown). Specifically, the solenoid is turned on to release the pressing operation of the sheet trailing edge pressing unit 208 in association with the conveying of a sheet and, after the sheet has passed though the sheet eject roller 205, the solenoid is turned off to press the sheet.

The sheet eject tray 206 serves as an sheet eject tray of which downstream side in the sheet conveying direction is fixed. The sheet eject tray 206 includes a movable tray unit 207 on its upstream side. The movable tray unit 207 is lifted up/down by a tray DC motor (not shown) and a cam link mechanism (not shown). The movable tray unit 207 has an upstream end serving as a pivotal end which can be swung relative to the fixed end of the tray 206 about a pivotal axis 207*a*. The operation end of the cam link mechanism is connected to the movable tray unit 207. Accordingly, the tray DC motor rotates and, in accordance with the rotation, the movable tray unit 207 swings about the pivotal axis 207*a*. Once the stacked sheets reach a predetermined number, the tray DC motor rotates according to an instruction from the controller described below and lowers the free end of the movable tray unit 207. Accordingly, the distance from the nip between the pair of rollers 205, 205*a* to the sheet stacking portion of the movable tray unit 207 increases. Thereby, a much larger number of sheets can be stacked.

A tray sheet surface sensor (not shown) is arranged on the sheet trailing edge pressing unit 208. While the sheet trailing edge pressing unit 208 is pressing a sheet, if the tray sheet surface sensor is off, the sheet eject tray 206 is lifted up until the sheet surface sensor is turned on and, if the tray sheet surface sensor is on, the sheet eject tray 206 is lowered until the sheet surface sensor is turned off, and then the sheet eject tray 206 is lifted up again until the sheet surface sensor is turned off. In this manner, the height of the sheet eject tray 206 on which sheets are stacked is kept constant. By repeating this operation, sorted sheets are stacked on the sheet eject tray 206.

FIG. 4 is a flowchart of a procedure in the shift mode. A CPU 401 described below executes the control. The openable/closable sheet eject guide plate 204 waits at the home position and, when receiving a sheet, the free end side (side at which the following sheet eject roller 205*a* supports) of the openable/closable sheet eject guide plate 204 moves to a lower position and the movable portion of sheet eject tray 207 lifts up. If, in this state, a sheet is received from the guide plate 201 (step S101), the inlet rollers 202 and the staple sheet eject rollers 203 convey the sheet (step S102), the openable/closable sheet eject guide plate 204 closes (step S103) and the sheet is ejected. In this state, the sheet eject roller 205 conveys the sheet (step S104) and, after the sheet trailing edge pressing unit 208 moves back (step S105), the sheet is ejected to the sheet eject tray 206 (step S106).

The ejected sheet is pressed by the sheet trailing edge pressing unit 208 at the trailing edge of the movable tray unit 207 of the sheet eject tray 206 (step S107), and the sheet eject process ends. The process to close the openable/closable sheet eject guide plate 204 and the process to move back the sheet trailing edge pressing unit 208 may be inversed in their executing timings. Although not illustrated, the sheet trailing edge pressing unit 208 detects the sheet surface level and lifts up/down the movable tray unit of the sheet eject tray for every few sheets to achieve a target sheet surface level.

2.2 Stapling Mode

In the stapling mode, when sheets are ejected, each set of a predetermined number of sheets is stapled by the stapler and ejected.

The hit roller 210, which is driven in the vertical direction by a stepping motor (not shown), is arranged between the staple sheet eject rollers 203 provided at the most downstream side end of the guide plate 201 and the openable/closable sheet eject guide plate 204 provided at a position just before the position where sheets are ejected to the sheet eject tray 206. The hit roller 210 includes a lever part that moves up/down and a roller part. The roller part is driven by a sheet ejection motor (not shown) so as to rotate in the direction opposite to the sheet conveying direction.

In the stapling mode, the hit roller 210 is lowered at a timing when the rear end of the sheet passes through the pair of the staple sheet eject rollers 203. The sheet is pressed by the roller part against the staple tray 209 serving as a stacking unit, and the roller part is rotated to switch back the sheet so as to abut the trailing edge of the sheet against the rear end reference fence 212. The trailing edge back roller 211 driven by the inlet motor (not shown) is arranged above the rear end reference fence 212 to support the sheet switch back and align sheets in the sheet conveying direction. In this alignment, the sheet reference is set to the rear end reference fence 212 by abutting the trailing edge of the sheet against the rear end reference fence 212.

When the sheet switch back is completed, the jogger fence 213 arranged on the staple tray 209 moves to push the sheet against the jogger fence 214 in the direction orthogonal to the sheet conveying direction and abuts against the sheet edge to align the sheet with the reference position. In this case, a part of the trailing edge surface of the sheets is inserted to a staple position with needle of the stapler 215 as staling unit. At that positron, the sheets are stapled after several processes including conveying a predetermined number of sheets, the switch back operation, and the alignment process. Therefore, the rear end reference fence 212 and the jogger fence 213 do function as the alignment unit. Incidentally, the stapler 215 moves to the staple position by a conveying and driving mechanism including a driving motor (not shown) before performing the staple operation.

After the staple operation, the openable/closable sheet eject guide plate 204 is lowered. The bundle of sheets is held between the sheet eject roller 205 and the following sheet eject roller 205*a*, which is attached to the openable/closable sheet eject guide plate 204. The bundle of sheets is ejected to the sheet eject tray 206 by driving the sheet ejection motor. After the sheet ejection motor is driven for certain steps from starting the sheet eject of the bundle of sheets, the solenoid is turned on to release the sheet trailing edge pressing unit 208 such that the sheet trailing edge pressing unit 208 moves in the direction represented by the arrow 223 and returns to a position where it does not obstruct the sheet ejection (sheet eject) and then the sheet eject tray 206 is lowered a certain distance. At a timing when the rear end of bundle sheets passes through the bundle sheet eject sensor, the sheet eject guide plate is lifted up to stand by for the next sheet with stopping the sheet ejection motor. At the same timing, the solenoid is turned off to press the sheets.

Figure 5:
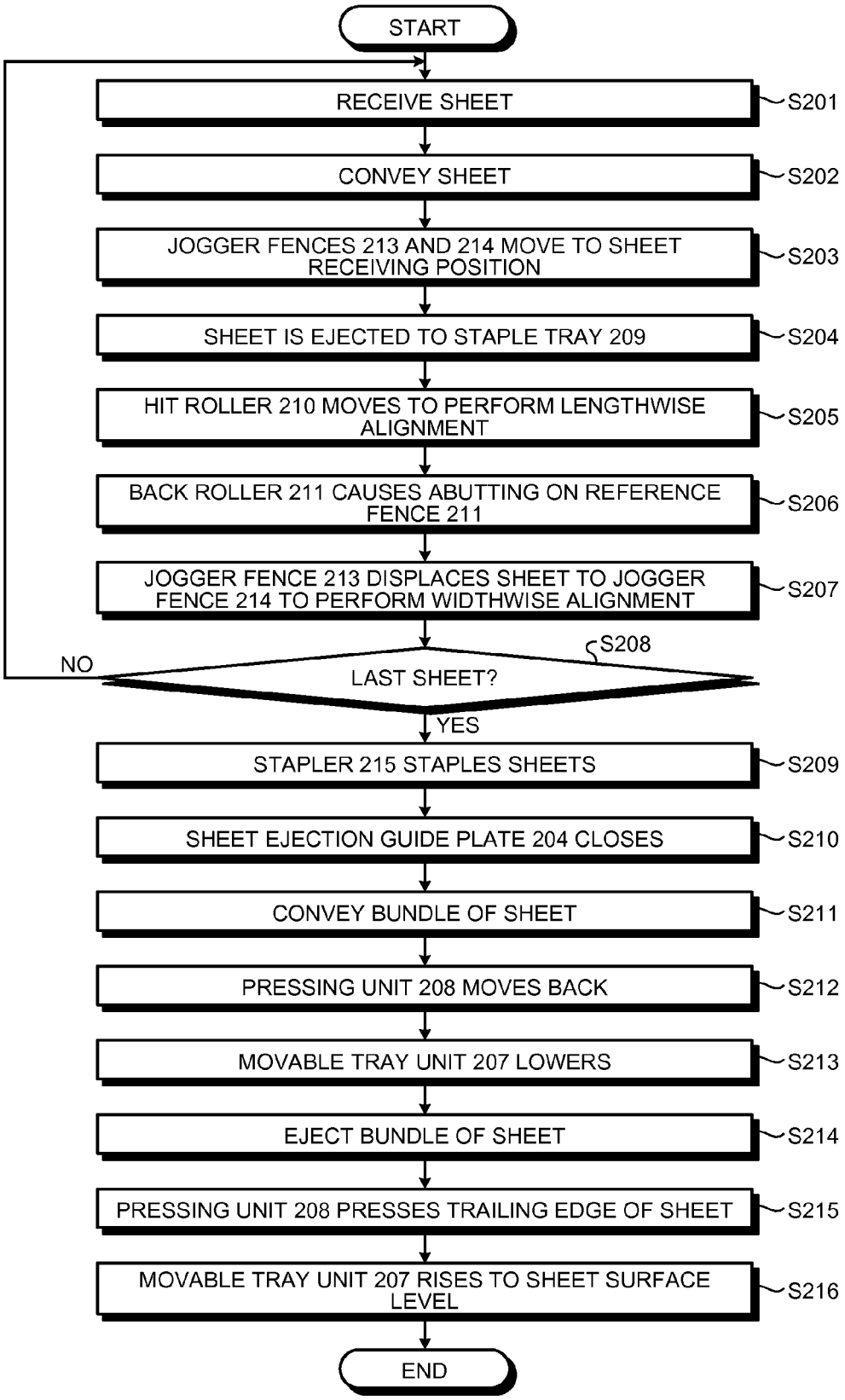
FIG. 5 is a flowchart of a procedure in a stapling mode.
Figure 6:
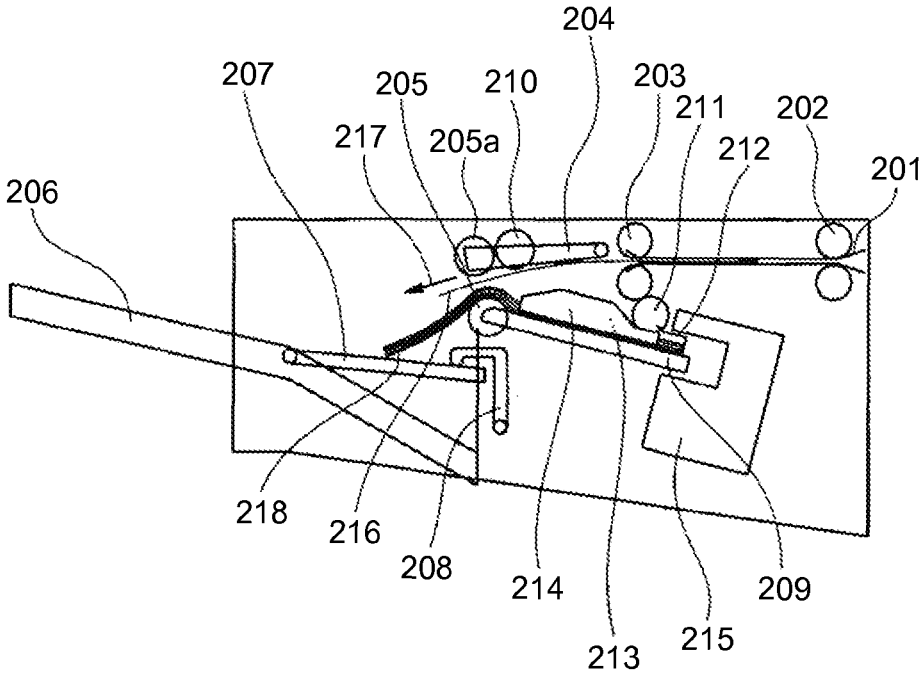
FIG. 6 is an operation explanatory view depicting an operation in the stapling mode and depicting a sheet being received from a guide plate.
Figure 7:
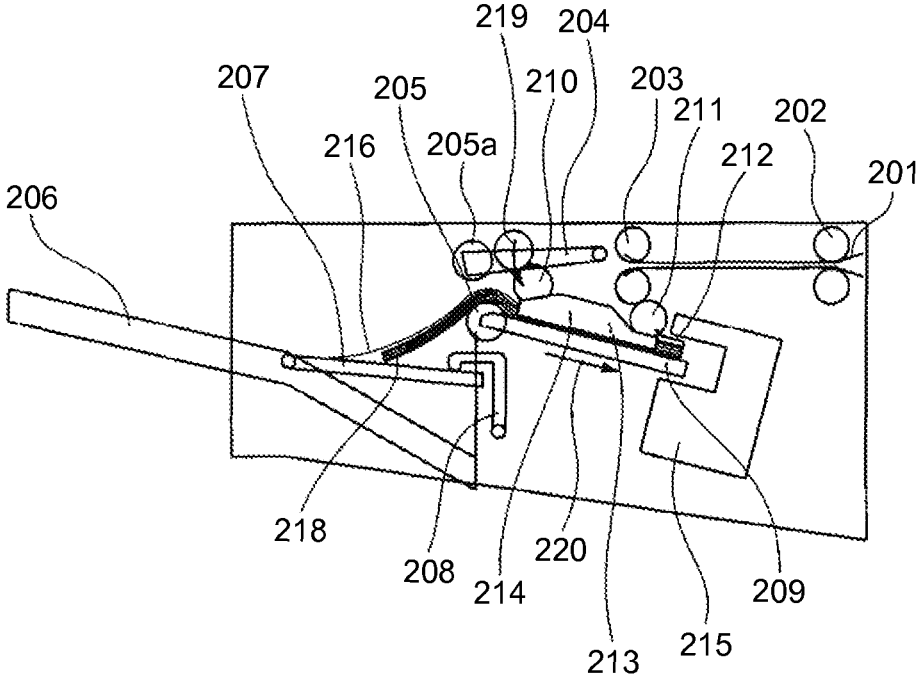
FIG. 7 is an operation explanatory view depicting an operation in the stapling mode and depicting a hit roller moving a sheet to a downstream side.
Figure 8:
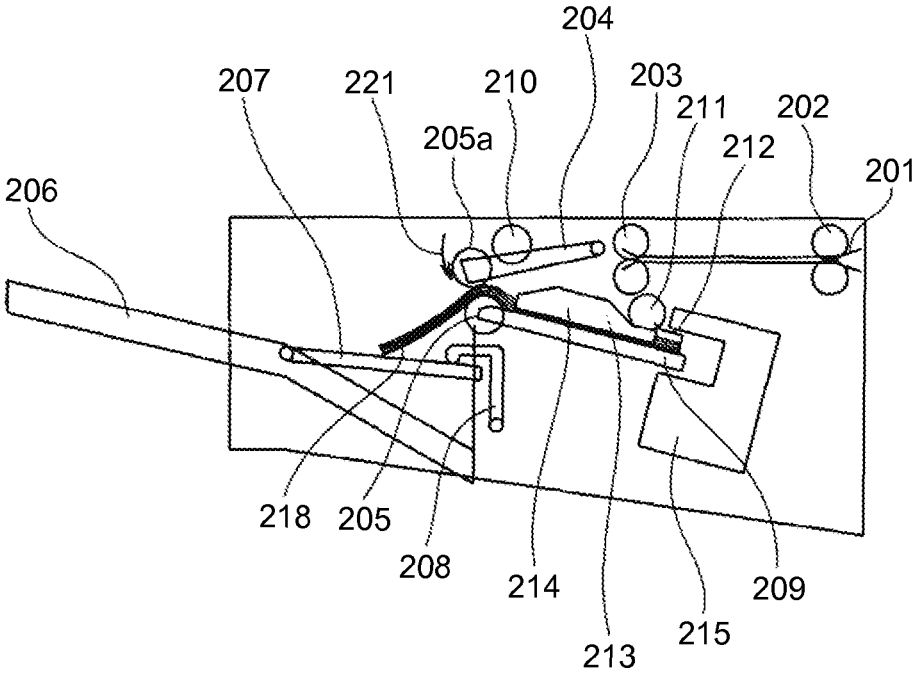
FIG. 8 is an operation explanatory view depicting an operation in the stapling mode and depicting a return roller abutting the sheet trailing edge against a rear end reference fence to perform an alignment operation in a conveying direction.

FIG. 5 is a flowchart of a procedure in the stapling mode and FIGS. 6 to 10 are operation explanatory views depicting the operation in the stapling mode. When receiving a sheet 216, as shown in FIG. 6, a free end side (the side on which the following sheet eject roller 205*a* is supported) of the openable/closable sheet eject guide plate 204 moves to a lower position and the movable tray unit 207 of sheet eject tray lifts up. If the sheet is received from the guide plate 201 in this state (step S201), the sheet 216 is conveyed by the inlet rollers 202 and the staple sheet eject rollers 203 as depicted by the arrow 217 (step S202). The jogger fence 213 then moves to a sheet receiving position (step S203), the sheet 216 is ejected to the staple tray 209 (step S204 ), the sheet 216 is moved by the hit roller 210 to the downstream side (in the direction denoted by the arrow 220) as shown in FIG. 7 (step S205), the back roller 211 abuts the rear end of the sheet against the rear end reference fence as shown in FIG. 8, and the alignment operation in the conveying direction is performed (step S206). Accordingly, the front end of the sheet 216 is positioned at the sheet eject tray 206 and the rear end of the sheet is positioned at the staple tray 209. Therefore, the sheet is ejected and stacked with extending over the sheet eject roller 205. FIG. 6 depicts a state that the sheet is already stacked on the staple tray 209 and the next sheet is conveyed onto an aligned bundle of sheets 218.

After the alignment operation in the conveying direction is completed, the jogger fence 213 is driven to displace the sheet 216 toward the front reference jogger fence 214 and an alignment operation in the direction orthogonal to the conveying direction is performed (step S207). Step S206 is lengthwise alignment and step S207 is widthwise alignment. This operation is repeated from the first sheet to the last sheet (step S208) and, when sheet ejection and alignment operations for the last page are completed, the stapler 215 staples the end of the sheet group (step S209), the openable/closable sheet eject guide plate 204 is closed as depicted by the arrow 221 in FIG. 8 (step S210), and the sheet group 218 is conveyed by the sheet eject roller 205 and the following sheet eject roller 205*a* to the sheet eject tray 206 (step S211, arrow 222).

Figure 9:
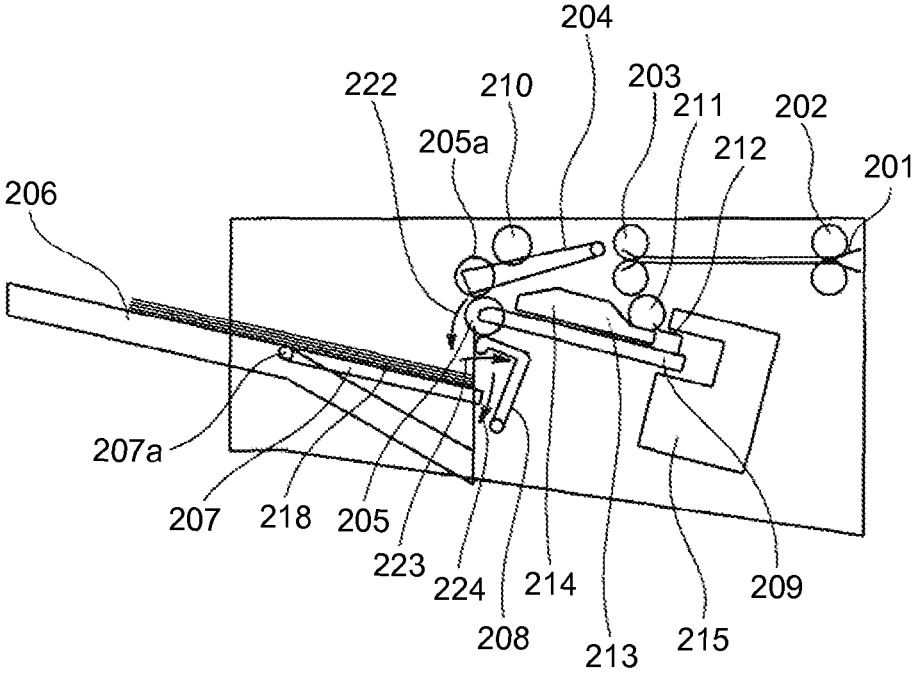
FIG. 9 is an operation explanatory view depicting an operation in the stapling mode and depicting a group of sheets being ejected onto an sheet eject tray.
Figure 10:
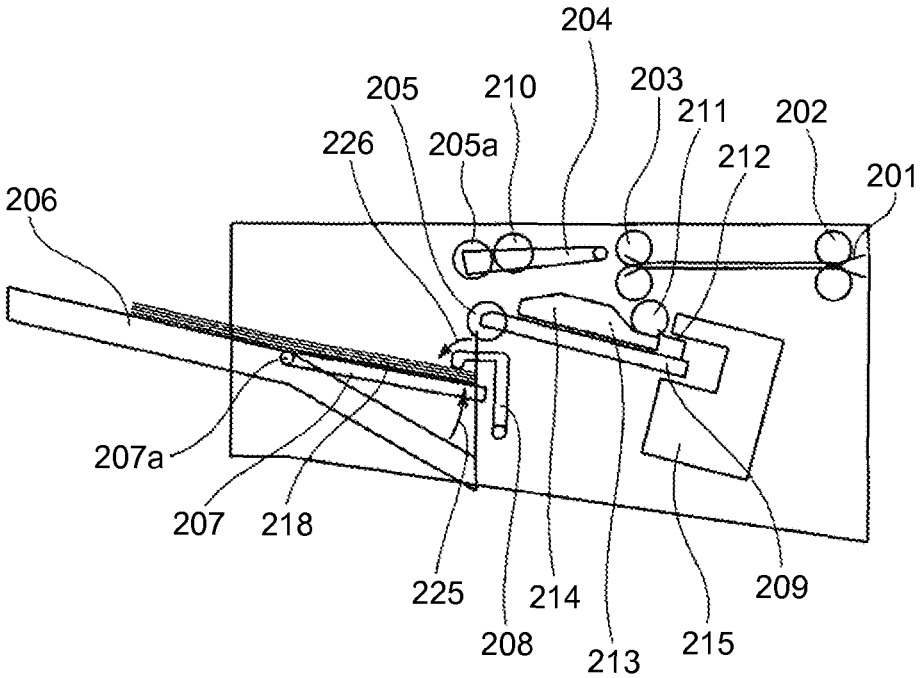
FIG. 10 is an operation explanatory view depicting an operation in the stapling mode and depicting the trailing edge of the sheet group being pressed.

Meanwhile, as shown in FIG. 9, the sheet trailing edge pressing unit 208 evacuates from the sheet eject tray 206 (step S212, arrow 223), the movable tray unit 207 of the sheet eject tray is lowered (step S213, arrow 224), and the sheet group is released onto the sheet eject tray 206 (step S214). After the trailing edge of the sheet group 218 falls down, the sheet trailing edge pressing unit 208 presses the trailing edge of the sheet group as shown in FIG. 10 (step S215, arrow 226), the movable tray unit 207 is lifted up to the sheet surface level (step S216, arrow 225) and the process ends.

2.3 Stapling Operation

Figure 11:
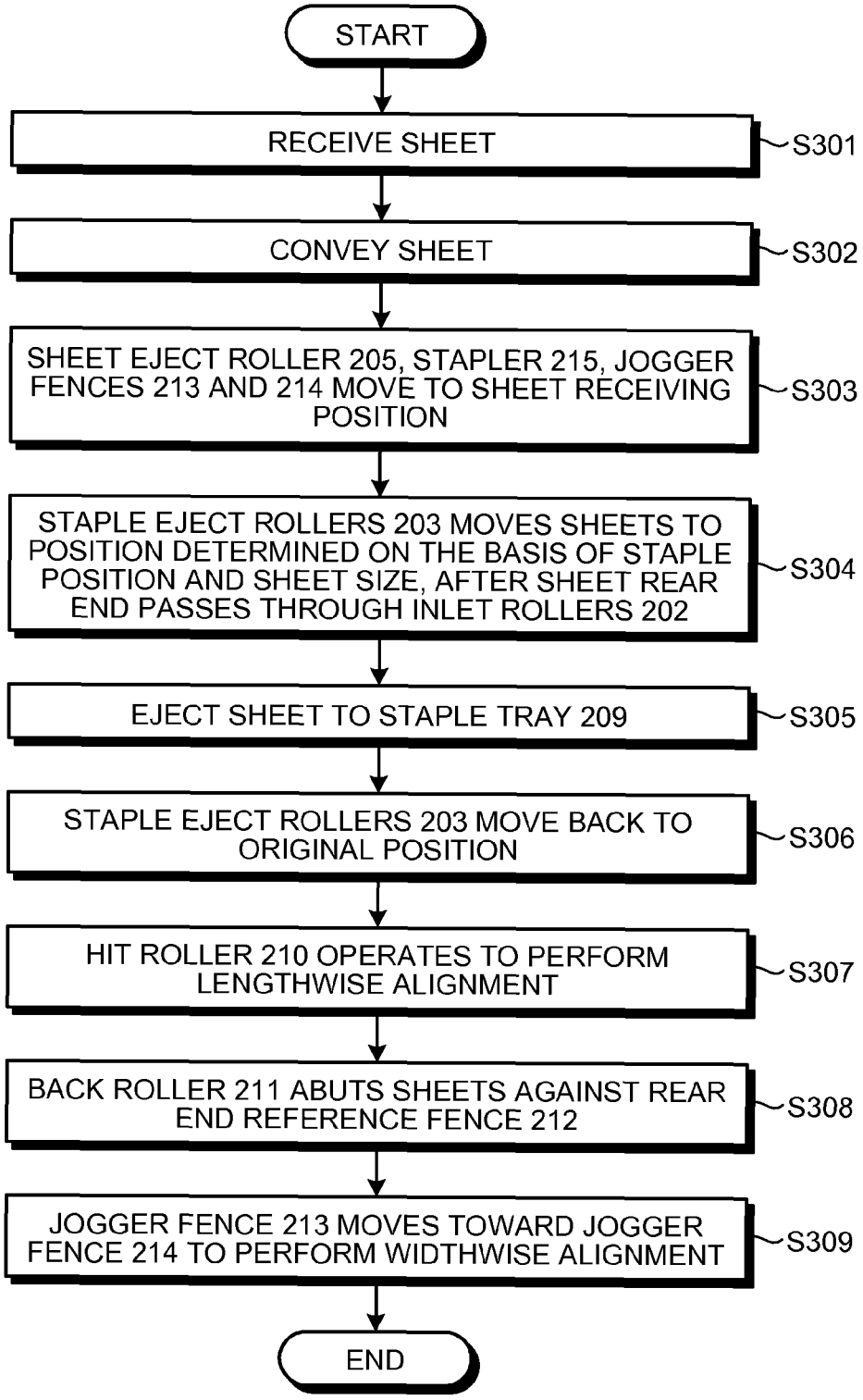
FIG. 11 is a flowchart of a procedure of the alignment operation on a staple tray during a stapling operation in the stapling mode.

FIG. 11 is a flowchart of a procedure of the alignment, operation on the staple tray during the stapling operation in the stapling mode and FIGS. 12 to 17 are operation explanatory views depicting operations on the staple tray 209 from sheet receiving during front stapling to sheet alignment and sheet group ejection on the staple tray 209.

Figure 12:
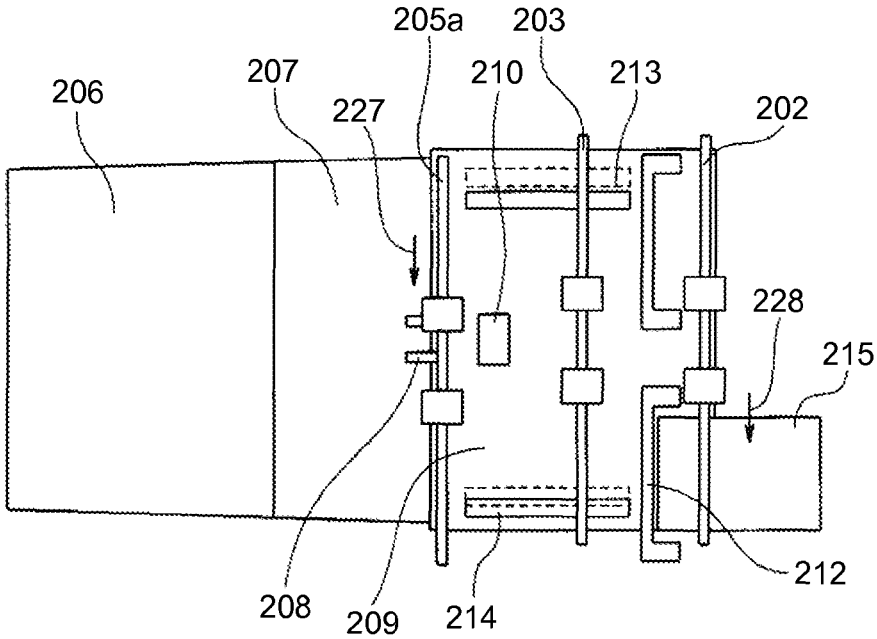
FIG. 12 is an operation explanatory view depicting an operation on the staple tray during front stapling and depicting the sheet ejection roller moving before receiving a sheet.

When an instruction for front stapling is received from the image forming apparatus 100, as shown in FIG. 12, the sheet eject roller 205 provided so as to shifts a predetermined distance in the direction denoted by the arrow 227 depending on the sheet size and stapling position. The stapler 215 moves to the stapling position. This movement is in the direction orthogonal to the sheet conveying direction, i.e., the sheet width direction (the direction represented by the arrow 228). The jogger fences 213 and 214 move to a receptive position to receive the sheet, which is determined depending on the sheet size and the stapling position and receive the sheet 216 (steps S301 to S303).

Figure 13:
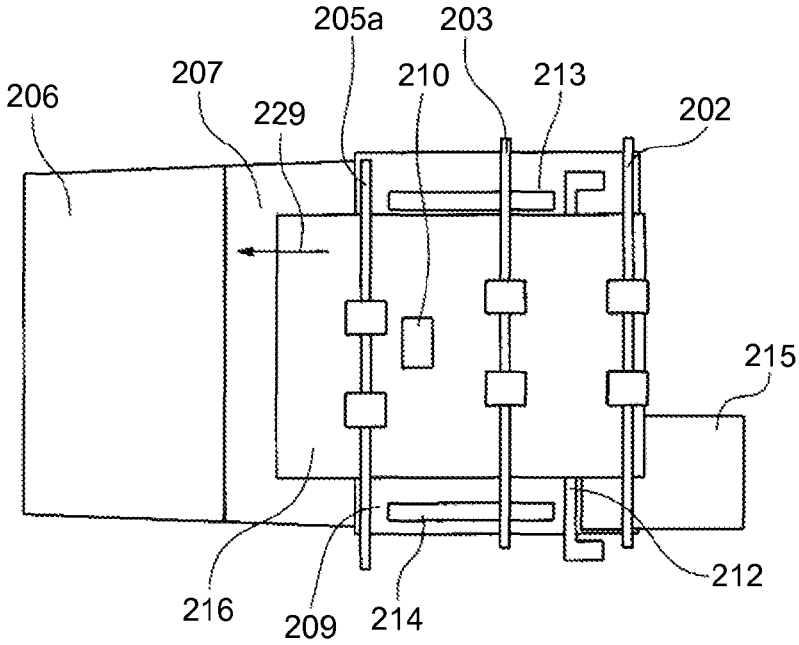
FIG. 13 is an operation explanatory view depicting an operation on the staple tray during front stapling and depicting a sheet being received and the sheet ejection roller conveying the sheet.
Figure 14:
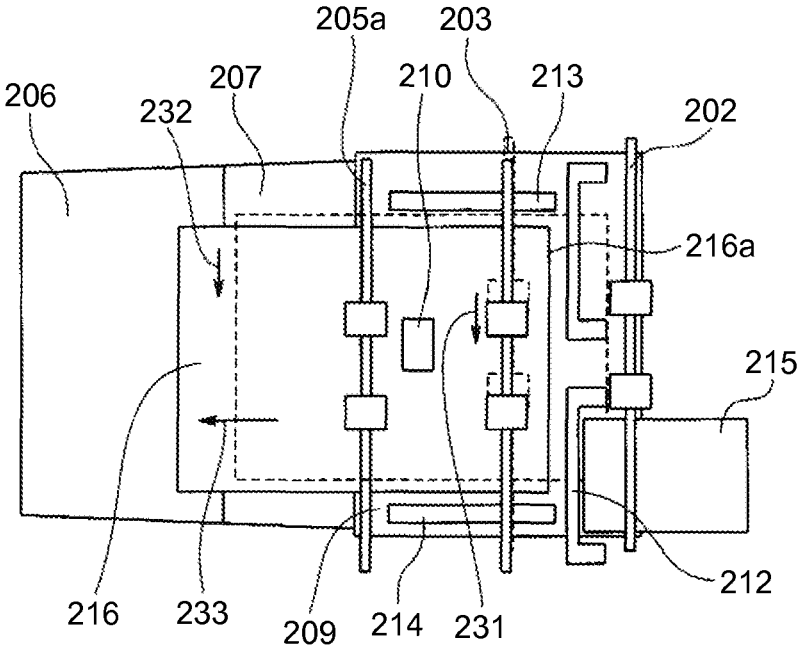
FIG. 14 is an operation explanatory view depicting an operation on the staple tray during the front stapling and depicting the stapling sheet ejection roller shifting to shift the sheet.

After the rear end of the sheet 216 conveyed in the direction represented by the arrow 229 in FIG. 13 passes thorough the inlet rollers 202, the staple sheet eject rollers 203 move in the direction represented by the arrow 231 (to the device front side) as shown in FIG. 14 to shift the sheet 216 in the direction represented by the arrow 232 (to the device front side) to a position kept away from the stapler 215 and the openable/closable sheet eject guide plate 204 is kept open (step S304).

Figure 15:
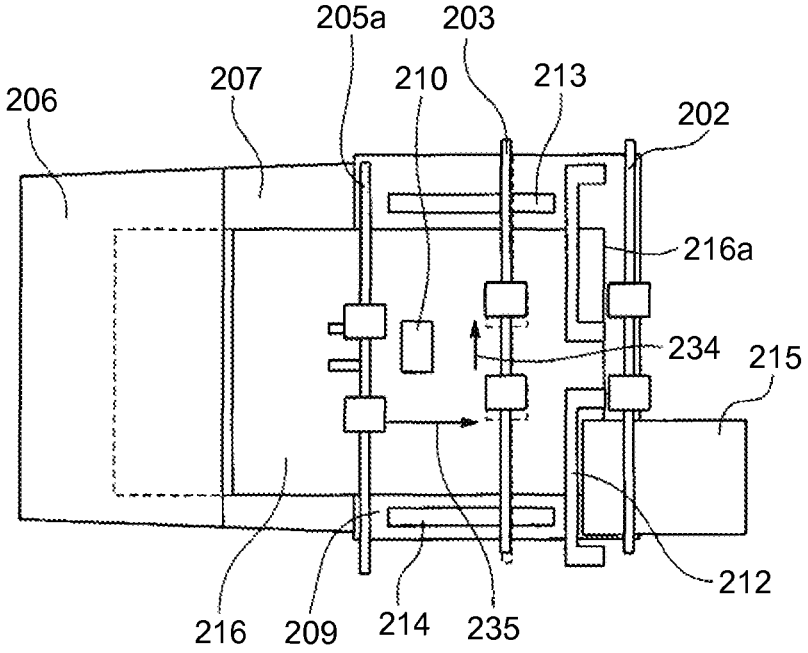
FIG. 15 is an operation explanatory view depicting an operation on the staple tray during the front stapling and depicting the sheet abutting against the rear end reference fence on the staple tray and thus the trailing edge being aligned.

After the rear end 216*a* of the sheet passes through the staple sheet eject rollers 203 and is ejected to the staple tray 209 (step S305), the staple sheet eject rollers 203 move in the direction represented by the arrow 234 as shown in FIG. 15 to the position where they wait for the next sheet (step S306). After the sheet 216 falls onto the staple tray 209, the hit roller 210 rolls back the sheet 216 in the direction represented by the arrow 235 (step S307) and the rear end 216*a* of the sheet is aligned by the rear end reference fence 212 (step S308).

Figure 16:
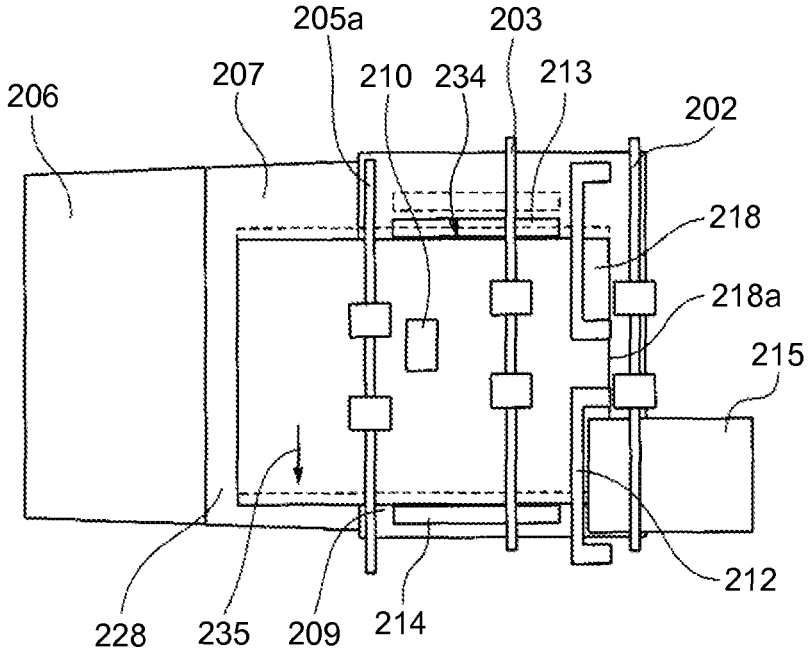
FIG. 16 is an operation explanatory view depicting an operation on the staple tray during the front stapling and depicting the sheet being displaced by jogger fences.

As shown in FIG. 16, the jogger fence 213 displaces the sheet 216 toward the jogger fence 214 to complete the alignment, of the sheet 216 on the staple tray 209 (step S309).

Figure 17:
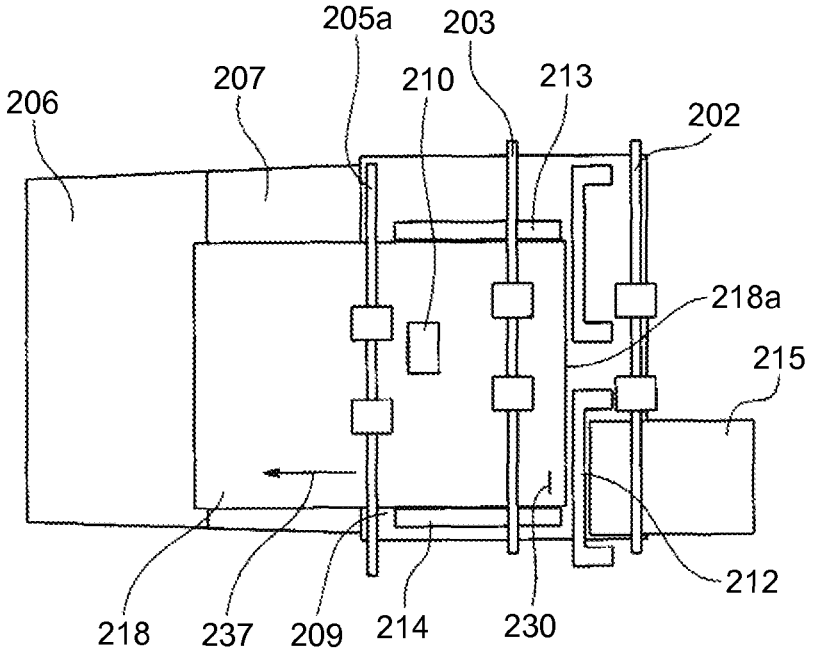
FIG. 17 is an operation explanatory view depicting an operation on the staple tray during the front stapling and depicting the stapling process being performed in the state in FIG. 16 to eject the stapled sheet group.

This operation is repeated until the last sheet to be stapled is aligned. As shown in FIG. 17, after the alignment operation on the last sheet is completed, the stapler 215 performs the stapling operation and the stapled sheet group 218 is conveyed by the sheet eject roller 205 in the direction represented by the arrow 237 and is ejected to the sheet eject tray 206. Because the sheet eject roller 205 has shifted to a position appropriate to eject the sheet group 218, skews are prevented and smooth ejection is allowed. A rear end 218*a* of the sheet group 218 is controlled by the rear end reference fence 212 and the distance between this position and a stapling needle 230 is determined.

2.4 Arrangement of a Plurality of Hit Rollers

Figure 18:
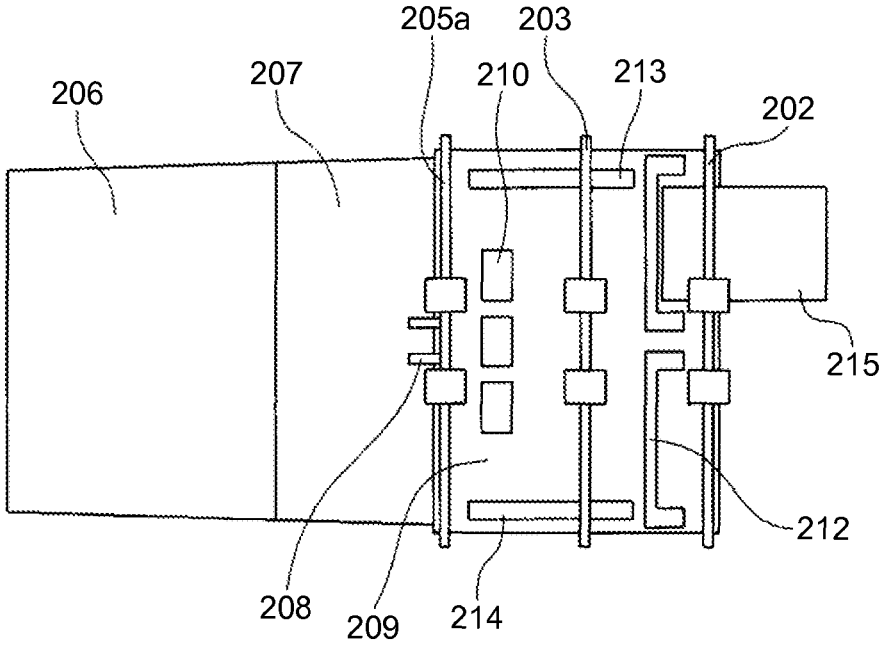
FIG. 18 is a plane view depicting an exemplary sheet processing device including a plurality of hit rollers arranged in parallel.

FIG. 18 is a plan view depicting an exemplary sheet processing device including a plurality of hit rollers 210 arranged in parallel.

In the above-described example, one hit roller 210 is arranged. In this example, however, the plurality of hit rollers 210 is arranged in parallel. In the case that the plurality of hit rollers is arranged, two or more rollers always make contact with the sheet while rolling back the sheet, when the sheet 216 shifted to up and down in the figure plane is rolled back to the rear end reference fence 212. Accordingly, even if the sheet is not on the conveying center, the hit rollers 210 can perform a rolling-back operation that is more stable compared to when only one hit roller 210 is used. The width-direction size, the number, and arrangement of hit rollers are set such that two or more rollers make contact with the sheet regardless of the sheet size and the shifted distance.

2.5 Sheet Displacement by Jogger Fence and Staple Position

Figure 19:
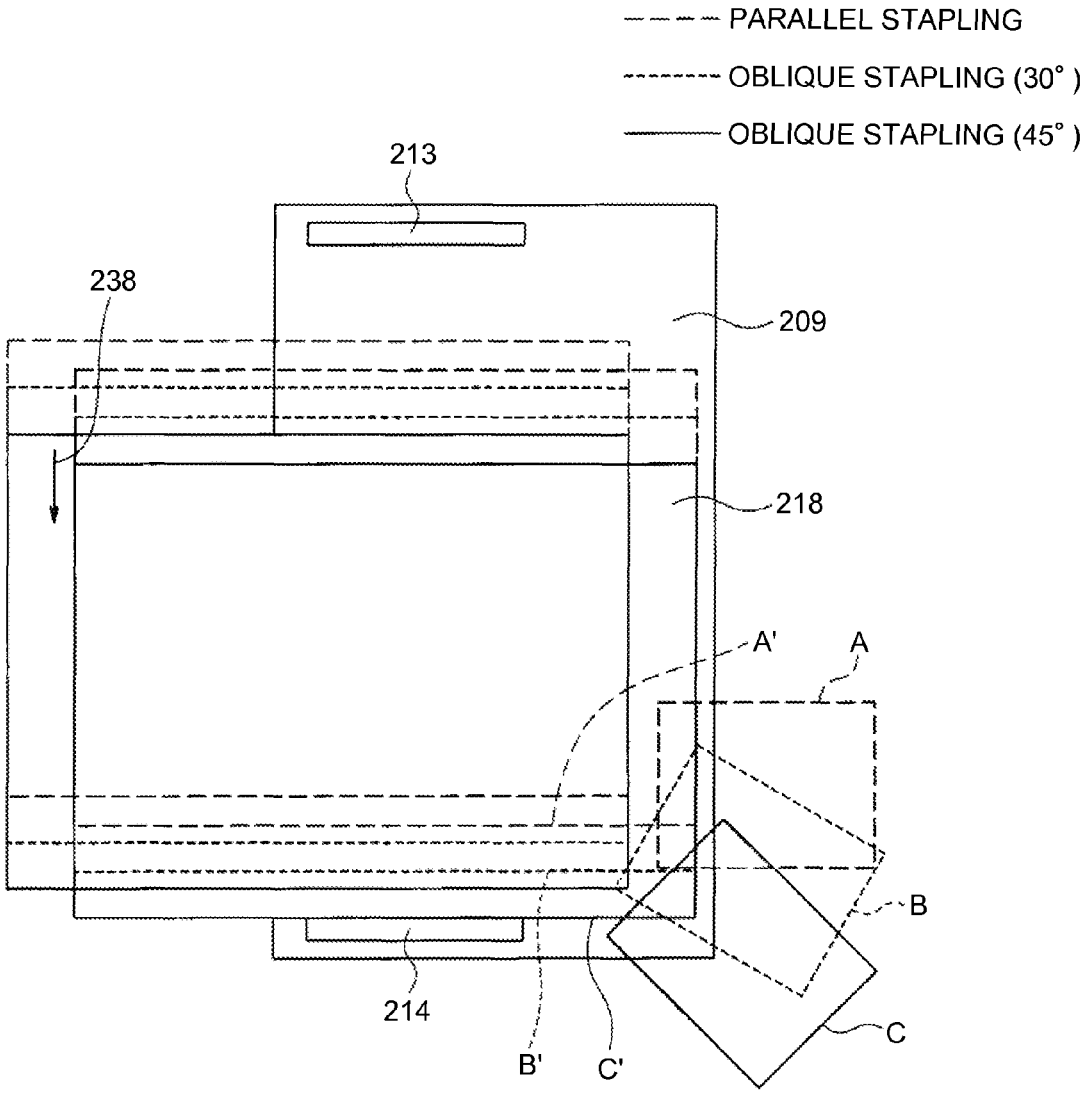
FIG. 19 is an explanatory view depicting stapling sheet ejection positions depending on stapling positions and the positions of the sheet displaced by the jogger fences in one direction during the stapling process.

FIG. 19 shows some positions of the sheet on the staple tray depending on staple positions, and shows some states that the sheet is displaced on the staple tray toward one direction by the jogger fence for the staple operation. The stapler 215 reciprocates along the rear end 216*a* of the sheet. However, if the stapler 215 moves further to the front side (downward of the figure) from the staple position with respect to the side end of the sheets shown in FIGS. 16 and 17 (represented by the broken line), the stapler 215 moves obliquely. At the most front position, the stapler 215 has obliqueness of 45 degrees. On the way to the most front position, there is a position where the stapler 215 has obliqueness of 30 degrees. Stapling positions for parallel stapling and oblique stapling at 30 degrees or 45 degrees are assigned depending on the position of the stapler 215. The position of the sheet on the staple tray and the positions of jogger fences 213, 214 are determined so that the displace amount of the sheet by the jogger fence to the alignment position, which is different among respective staple positions, is always constant.

Specifically, in FIG. 19, the broken line represents the parallel stapling, the dotted line represents the 30° oblique stapling, and the solid line represents the 45° oblique stapling each showing the relationship between the bundle of sheets 218 and the stapler 215. As can be understood from FIG. 19, the displaced position shifts more the front side in the order from A', B' and C' where A' represents the displaced position by the jogger fences 213, 214 for the parallel stapling, B' represents the displaced position for the 30° oblique stapling and C' represents the displaced position for the 45° oblique stapling. According to this, the position of the stapler 215 shifts more the front side in the order from A, B and C where A represents for the parallel stapling, B represents for the 30° oblique stapling, and C represents for the 45° oblique stapling. Incidentally, the front side means a direction represented by an arrow 238 in FIG. 19.

The mechanism to perform oblique stapling is achieved by a cam. Since the cam mechanism is well known as disclosed by Japanese Patent Application Laid-open No. 2000-335815, Japanese Patent Application Laid-open No. 2000-289921 and the like, description thereof will be omitted here.

2.6 Separating Mechanism of Inlet Rollers

Figure 20:
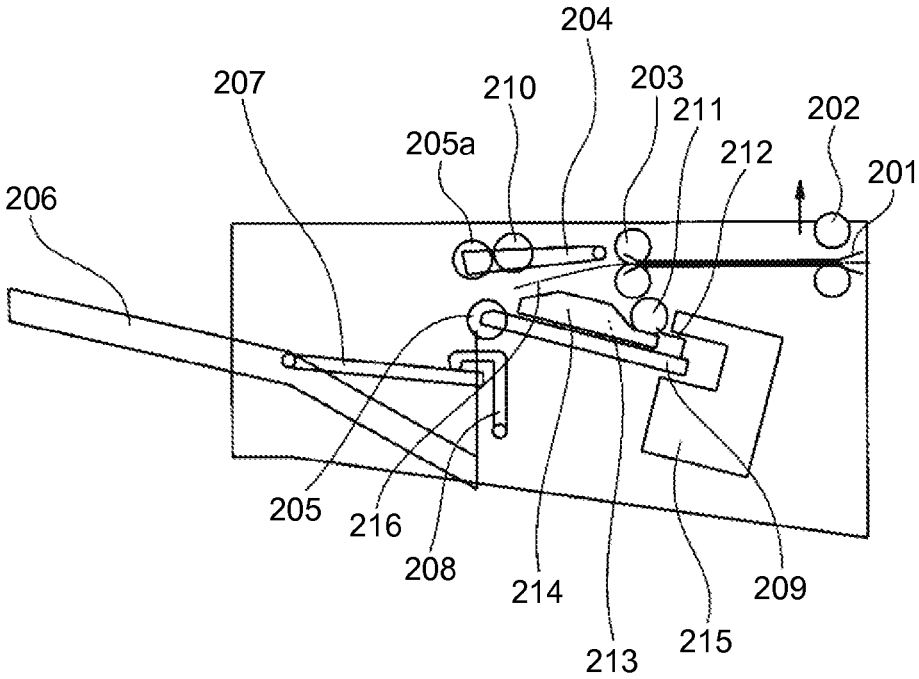
FIG. 20 is a diagram of an example in which inlet rollers are separable.

FIG. 20 is a diagram of an example in which the inlet rollers 202 are separable. If the inlet rollers 202 are separable, the sheet can be shifted and conveyed by the staple sheet eject rollers 203 before a rear end 216*a* of the sheet passes through the inlet rollers 202.

In order to separate the inlet rollers 202, a cam mechanism may be used to move an axis of a following roller among pair of rollers 202 with respect to a driven roller among pair of rollers 202. The movement of rollers can be controlled by CPU 401 (described below) that controls a motor for driving the cam mechanism. These mechanism may be a known mechanism as disclosed by Japanese Patent Application Laid-open No. 2006-232452 and the like. Other operations are as described above using FIG. 12 to FIG. 17.

3. Control Device

Figure 21:
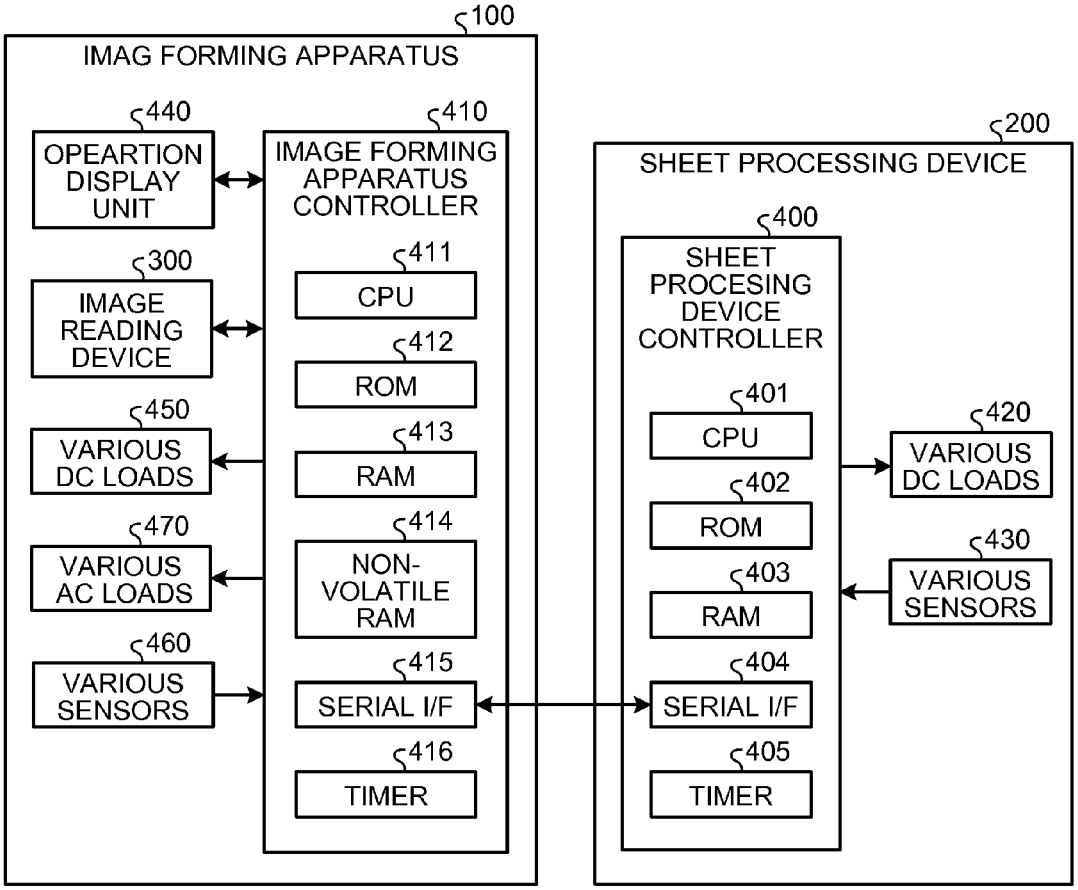
FIG. 21 is a block diagram of a system control configuration according to the embodiment of the present invention.

FIG. 21 is a block diagram of a system control configuration according to the present embodiment.

As shown in FIG. 21, the image forming apparatus 100 is controlled by an image forming apparatus controller 410 including therein a CPU 411, a ROM 412, a RAM 413, a non-volatile RAM 414, a serial I/F 415, a timer 416 and so on.

Control program codes are stored in the ROM 412. The CPU 411 loads the program codes to the RAM 413, stores data necessary for control in the RAM 413, uses the RAM as a work area and executes the program, which is defined by the program codes, to control each unit.

Various DC loads 450 including the motor used for the image forming unit 110 such as a photosensitive element, various motors and clutches for the sheet feeder 120, the sheet feeding conveying path 130 and the duplex conveying path 170; various AC loads 470; and various sensors 460 such as a temperature sensor to detect the temperature of the fixing roller, are connected to the image forming apparatus controller 410. In addition, the image reading device 300 and an operation display unit 440 are connected to the image forming apparatus controller 410 such that each unit is controlled via the image forming apparatus controller 410.

The sheet processing device 200 is controlled by a sheet processing device controller 400 including therein the CPU 401, a ROM 402, a RAM 403, a serial I/F 404, a timer 405 and so on. Control program codes are stored in the ROM 402. The CPU 401 loads the program codes to the RAM 403, stores data necessary for control in the RAM 403, uses the RAM as a work area and executes the program, which is defined by the program codes, to control various DC loads 420.

The image forming apparatus 100 and the sheet processing device 200 transmit and receive commands necessary for sheet conveying control via the serial I/F 415 and 404. On the basis of this commands and/or the sheet position information obtained from various sensors 430, the CPU 401 of the sheet processing device 200 performs various types of control including: a drive control of the openable/closable sheet eject guide plate 204, a drive control of the staple sheet eject rollers 203, a shift drive control of the shifting mechanism (not shown), a level position control of the sheet eject tray 206, a pivot control of the movable tray unit 207, a pivot control of the sheet trailing edge pressing unit 208, an alignment control of the jogger fence 213, an alignment control of the hit roller 210, a swing control of the swing member 228 with the solenoid 229, a lift, up/down control of the following sheet eject roller 205*a* by using the link, a sheet abut control using a sheet abut roller 232 and the hit roller 210 on the sheet, and a stapling control of the stapler 215.

In the present embodiment including various examples described above, the sheet processing device 200 is provided in the space between the image reading device 300 and the body of the image forming apparatus 100 including the image forming unit, but the space in which the sheet processing device 200 is placed is not limited to this embodiment. For example, if a style is used in which sheets are ejected from the side surface of the body of the image forming apparatus 100, the sheet processing device 200 may be set on the side surface of the body. Whatever the case, the position in which the sheet processing device 200 is arranged is set in accordance with the body shape, the body structure, and the sheet ejection position of the image forming apparatus 100. Note that the configuration, the operation and the control of the sheet processing device 200 are the same wherever the sheet processing device 200 is set or when it is arranged at the top of the integral sheet eject tray (housing tray) of the image forming apparatus 100.

According to the embodiments, the following effects are achieved as described above.

1) The shift amount (offset amount) of the sheet is changed depending on the staple position and the size of the sheet 216, so that the displacement by the jogger fences 213, 214 is constant for aligning the sheet 216 in a direction (width direction) orthogonal to the sheet conveying direction, regardless of the staple position and the size of the sheet, when effecting the sheet 216 to the staple tray 209. Thereby, the shift amount of the jogger fences becomes minimum, resulting in the improved productivity and the improved alignment operation.
2) The staple sheet eject rollers 203 are shifted. Thereby, there is no need to dispose another shift roller.
3) The pair of inlet rollers 202 are separable, which are located upstream of the staple sheet eject rollers 203. Thereby, the sheet 216 can be shifted without waiting until the rear end of the sheet passes through the pair of inlet rollers 202. As a result, the productivity is improved, since the sheet can be shifted even if the conveying path is relatively short with respect to the sheet length.
4) A plurality of hit rollers 210 may be disposed in parallel. In this case, the alignment defect can be prevented, since the skew of the sheet can be prevented when the sheet is rolled back to the reference fence from various positions in the sheet width direction depending on the staple position and the size of the sheet.
5) The sheet eject roller 205 is shifted in the sheet width direction. Thereby, the sheet eject roller 205 can be moved in advance to a position corresponding to a post-shifted position of the sheet. Therefore, the skew of the bundle of the sheet can be prevented when ejecting the bundle of the sheets, resulting in the prevention of the stack defect of the bundle of the sheets.
6) The stapler 215 is arranged capable of performing a oblique stapling while positioning itself obliquely when moved in the front side and/or the back side by the moving unit. The angle of the oblique stapling can be selected arbitrarily through the operation display unit 440 of the body. The shift amount or the offset position of the staple sheet eject rollers 203 is determined on the basis of the selected angle. Thereby, it is possible to deal with a wide range of angles reflecting the user's preference.
7) The sheet processing device 200 is inserted a space between the image forming apparatus 100 and the image reading device 300 (so-called "inner shift tray").

According to an embodiment of the invention, the shift amount of the alignment units for aligning the sheet in a direction orthogonal to the sheet conveying direction becomes constant regardless of the staple position and the size of the sheet. Thereby, it is possible to prevent the reduction of the productivity, and the degradation of the alignment level.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device for stacking one or more sheets temporarily on a stacking unit, and stapling the sheets by a stapling unit after aligned by an alignment unit, the device comprising:

a shift unit that shifts the sheet in both a sheet conveying direction and a direction orthogonal to the sheet conveying direction; and a control unit that controls a shift amount of the shift unit so that an alignment distance of a width direction alignment unit to align the sheet in the direction orthogonal to the sheet conveying direction is constant regardless of a staple position and a sheet size, when stacking the sheets on the stacking unit.

2. The sheet processing device according to claim 1, wherein the shift unit includes:

a sheet eject roller to eject the sheets on the stacking unit; and a shift mechanism to shift the sheets in the direction orthogonal to the sheet conveying direction.

3. The sheet processing device according to claim 1, further comprising:

a pair of rollers to convey the sheets toward the shift unit, the pair of rollers being disposed an upstream in the sheet conveying direction of the shift unit; and a separating unit to separate the pair of rollers away from each other.

4. The sheet processing device according to claim 1, wherein the alignment unit includes a conveying direction alignment unit to align the sheet in the sheet conveying direction when stacking the sheets on the stacking unit, the conveying direction alignment unit including:

a rear end reference fence to which a rear end of sheets are abutted so that the sheets are aligned with respect to the rear end of sheets as reference; and a plurality of hit rollers disposed in parallel to each other to shift the sheets, which are conveyed on the stacking unit, toward the rear end reference fence.

5. The sheet processing device according to claim 1, further comprising:

an eject tray to stack thereon the sheets which are stapled by the staple unit; and an eject roller to eject the sheets onto the eject, tray, wherein the eject roller is arranged to move in the direction orthogonal to the sheet conveying direction.

6. The sheet processing device according to claim 1, further comprising:

a moving unit to move the staple unit along the rear end of the sheets for stapling operation, wherein the control unit determines the shift amount of the shift unit and the shift amount of the moving unit, on the basis of a staple angle for an oblique stapling by the staple unit, the staple angle capable of being input.

7. An image forming apparatus comprising a sheet processing device for stacking one or more sheets temporarily on a stacking unit, and stapling the sheets by a stapling unit after aligned by an alignment unit, the device comprising:

a shift unit that shifts the sheet in both a sheet conveying direction and a direction orthogonal to the sheet conveying direction; and a control unit that controls a shift amount of the shift unit so that an alignment distance of a width direction alignment unit to align the sheet in the direction orthogonal to the sheet conveying direction is constant regardless of a staple position and a sheet size, when stacking the sheets on the stacking unit.

8. A sheet processing method for conveying one or more sheets with a conveying unit, stacking the sheets temporarily on a stacking unit, and stapling the sheets by a stapling unit after aligned by an alignment unit, the method comprising:

conveying the sheets with the conveying unit in a direction orthogonal to a sheet conveying direction so that an alignment distance of a width direction alignment unit to align the sheets in the direction orthogonal to the sheet conveying direction is constant regardless of a staple position and a sheet size, before ejecting the sheets onto the stacking unit to stack the sheets thereon.

* * * * *